US005163200A

United States Patent [19]

Carlin et al.

[11] Patent Number: 5,163,200

[45] Date of Patent: Nov. 17, 1992

[54] FOOT SCRUBBING APPARATUS

[76] Inventors: Kevin S. Carlin; John J. Marhoefer, both of 17110 Skelton Pl., Dallas, Tex. 75248

[21] Appl. No.: 800,124

[22] Filed: Nov. 29, 1991

[51] Int. Cl.[5] ..... A47K 7/03

[52] U.S. Cl. ..... 15/104.92; 4/628; 15/114; 15/244.1; 222/206; 239/327; 401/183; 401/287

[58] Field of Search ..... 128/62 R, 66; 4/622, 4/628; 239/327; 222/206, 209, 214, 215; 401/6, 28, 183, 184, 287, 26; 15/104.92, 112, 113, 160, 161, 191 A, 114, 31, 36, 97.2, 244.1, 244.4; 134/198, 200

[56] References Cited

U.S. PATENT DOCUMENTS

| | | | |
|---|---|---|---|
| 2,591,331 | 4/1952 | Baumbach | 15/161 X |
| 2,852,793 | 9/1958 | Shelton | 15/104.92 |
| 3,283,756 | 11/1966 | Turley | 15/104.92 X |
| 3,467,978 | 9/1969 | Golden | 15/114 X |
| 3,543,747 | 12/1970 | Gustafson | 15/160 X |
| 3,548,439 | 12/1970 | Berst | 15/104.92 |
| 3,810,463 | 5/1974 | Krummenacher | 128/66 X |
| 3,821,951 | 7/1974 | Giles | 128/66 |
| 3,939,825 | 2/1976 | Krummenacher | 128/66 X |
| 3,966,335 | 6/1976 | Abramson | 401/183 X |
| 3,973,286 | 8/1976 | Logan | 15/104.92 X |
| 4,520,525 | 6/1985 | Yogi et al. | 15/104.92 |
| 4,532,668 | 8/1985 | Slonicki | 15/104.92 |
| 4,617,917 | 10/1986 | Miller | 15/161 X |
| 4,775,256 | 10/1988 | Roth | 128/66 X |
| 4,918,779 | 4/1990 | Burns | 15/104.92 |

FOREIGN PATENT DOCUMENTS

| | | | |
|---|---|---|---|
| 2507869 | 9/1976 | Fed. Rep. of Germany | 4/622 |
| 345868 | 6/1960 | Switzerland | 401/183 |
| 562600 | 6/1975 | Switzerland | 4/622 |

*Primary Examiner*—Harvey C. Hornsby
*Assistant Examiner*—C. Cooley
*Attorney, Agent, or Firm*—S. Michael Bender

[57] ABSTRACT

A foot scrubbing apparatus is arranged as a compressible housing formed with a rigid floor, including a matrix of suction cups thereon. The housing includes a first top wall oriented at an obtuse angle relative to a second top wall. The first top wall includes a matrix of bristles and the second top wall includes a replaceable sponge member directed therethrough, with the second top wall including a lid member hingedly mounted relative to the second top wall formed with an opening to secure a flange portion of the sponge head to the second top wall. Compression of the housing projects cleaning fluid and/or a lotion compound through communicating apertures in the first and second top walls relative to an interior portion or cavity of the housing.

3 Claims, 4 Drawing Sheets

FOOT SCRUBBING APPARATUS

BACKGROUND OF THE INVENTION

1. Field of the Invention

The field of invention relates to scrubbing apparatus, and more particularly pertains to a new and improved foot scrubbing apparatus wherein the same is arranged for the cleaning and massaging of a foot portion of an individual.

2. Description of the Art

Foot cleaning apparatus of various types have been utilized throughout the prior art in an effort to provide for a convenient cleaning of an individual's foot. Such apparatus is exemplified in U.S. Pat. No. 3,548,439 to Berst wherein a foot soaping and scrubbing device includes a shoe-like member to receive a foot portion therewithin.

U.S. Pat. No. 4,532,668 to Slonicki utilizes a foot scrubber with a soap dispenser that is remotely operative for an individual unable to reach that individual's feet.

U.S. Pat. No. 4,918,779 to Burns sets forth a foot spraying and cleaning device utilizing confronting brushes.

As such, it may be appreciated that there continues to be a need for a new and improved foot scrubbing apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of foot scrubbing apparatus now present in the prior art, the present invention provides a foot scrubbing apparatus wherein the same is arranged to provide for adjoining top wall surfaces of a housing member to permit application of a sponge or a brush assembly relative to an individual's foot for ease of access to various portions of the structure for the scrubbing and cleaning of an individual's foot. As such, the general purpose of the present invention, which will be described subsequently in greater detail, is to provide a new and improved foot scrubbing apparatus which has all the advantages of the prior art foot scrubbing apparatus and none of the disadvantages.

To attain this, the present invention provides a foot scrubbing apparatus arranged as a compressible housing formed with a rigid floor, including a matrix of suction cups thereon. The housing includes a first top wall oriented at an obtuse angle relative to a second top wall. The first top wall includes a matrix of bristles and the second top wall includes a replaceable sponge member directed therethrough, with the second top wall including a lid member hingedly mounted relative to the second top wall formed with an opening to secure a flange portion of the sponge head to the second top wall. Compression of the housing projects cleaning fluid and/or a lotion compound through communicating apertures in the first and second top walls relative to an interior portion or cavity of the housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon wich this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved foot scrubbing apparatus which has all the advantages of the prior art foot scrubbing apparatus and none of the disadvantages.

It is another object of the present invention to provide a new and improved foot scrubbing apparatus which may be easily and efficiently manufactured and marketed.

It is a further object of the present invention to provide a new and improved foot scrubbing apparatus which is of a durable and reliable construction.

An even further object of the present invention is to provide a new and improved foot scrubbing apparatus which is susceptible of a low cost of manufacture with regard to both materials and labor, and which accordingly is then susceptible of low prices of sale to the consuming public, thereby making such foot scrubbing apparatus economically available to the buying public.

Still yet another object of the present invention is to provide a new and inproved foot scrubbing apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
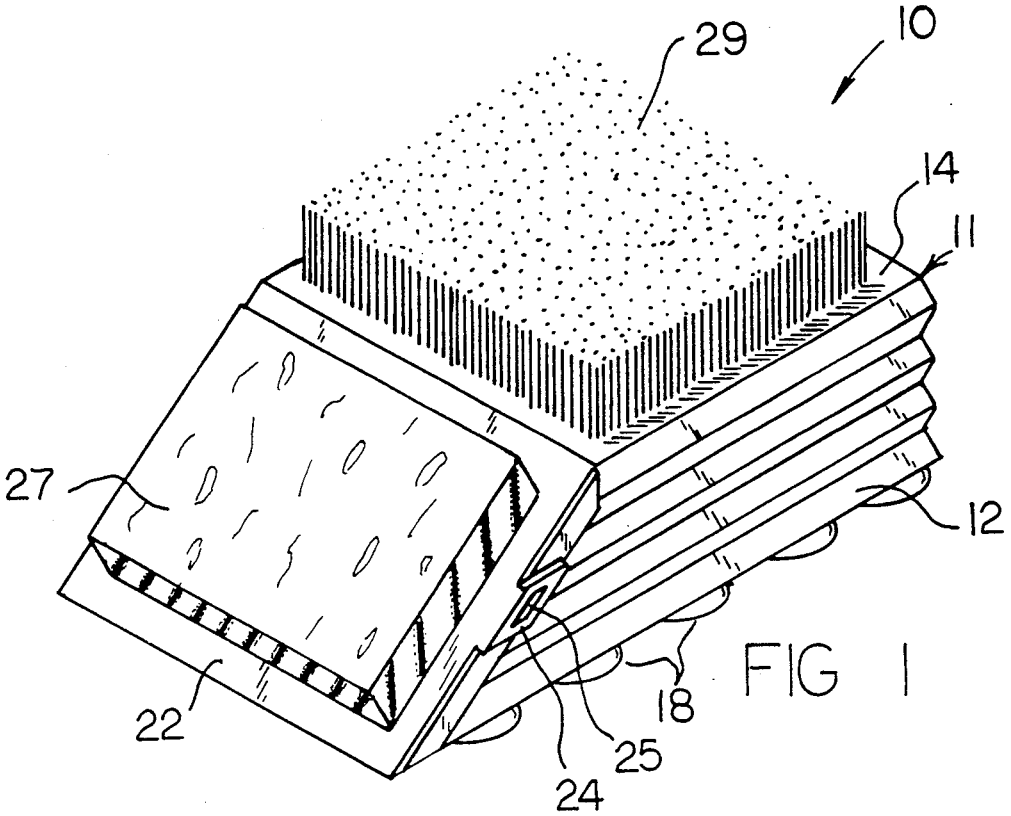
FIG. 1 is an isometric illustration of the instant invention.
Figure 2:
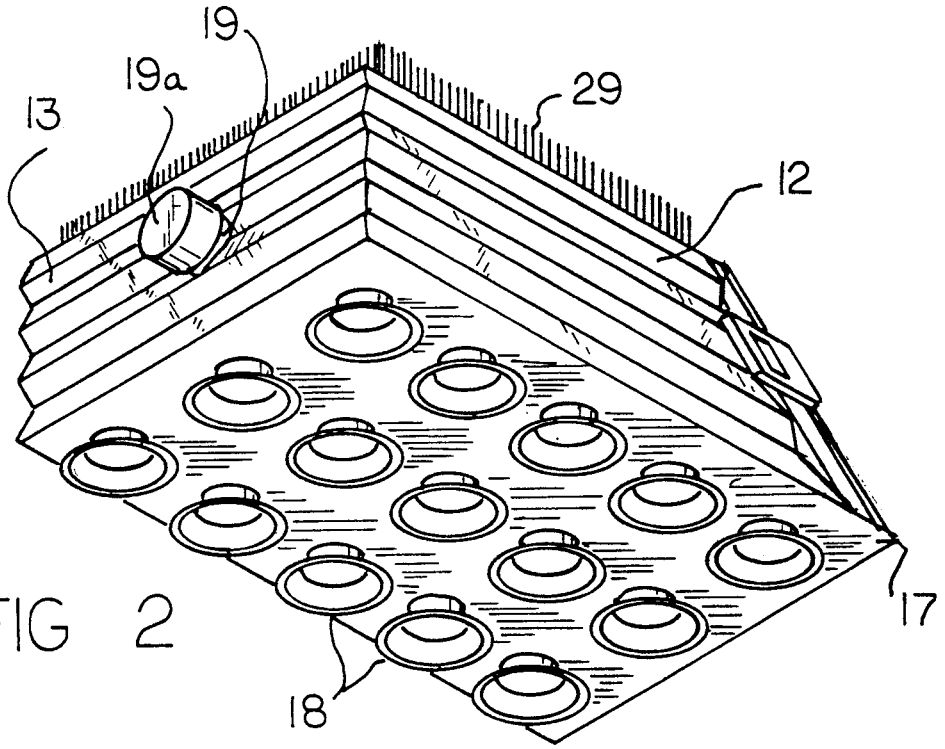
FIG. 2 is an isometric bottom perspective of the instant invention.
Figure 3:
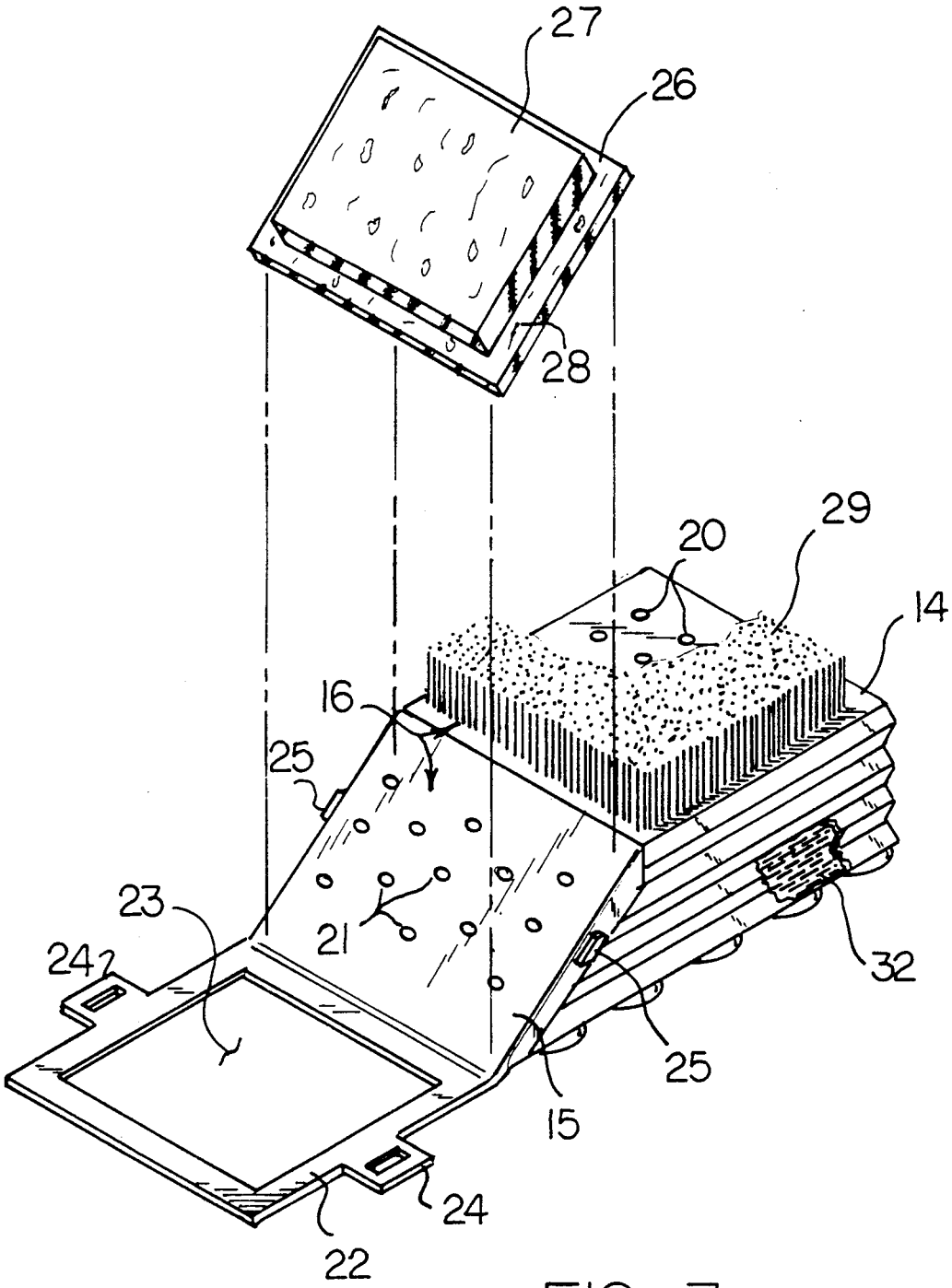
FIG. 3 is a isometric exploded illustration of the instant invention in fragmentary view to illustrate the various components thereof.
Figure 4:
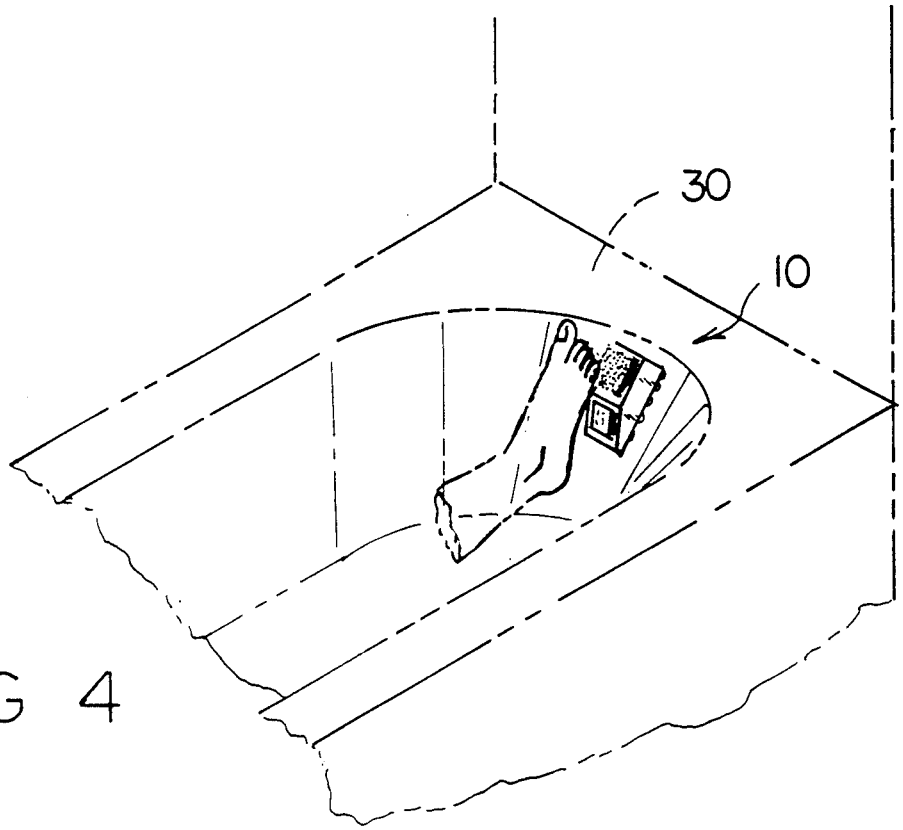
FIG. 4 is an isometric illustration of the instant invention in use within a bathtub environment.
Figure 5:
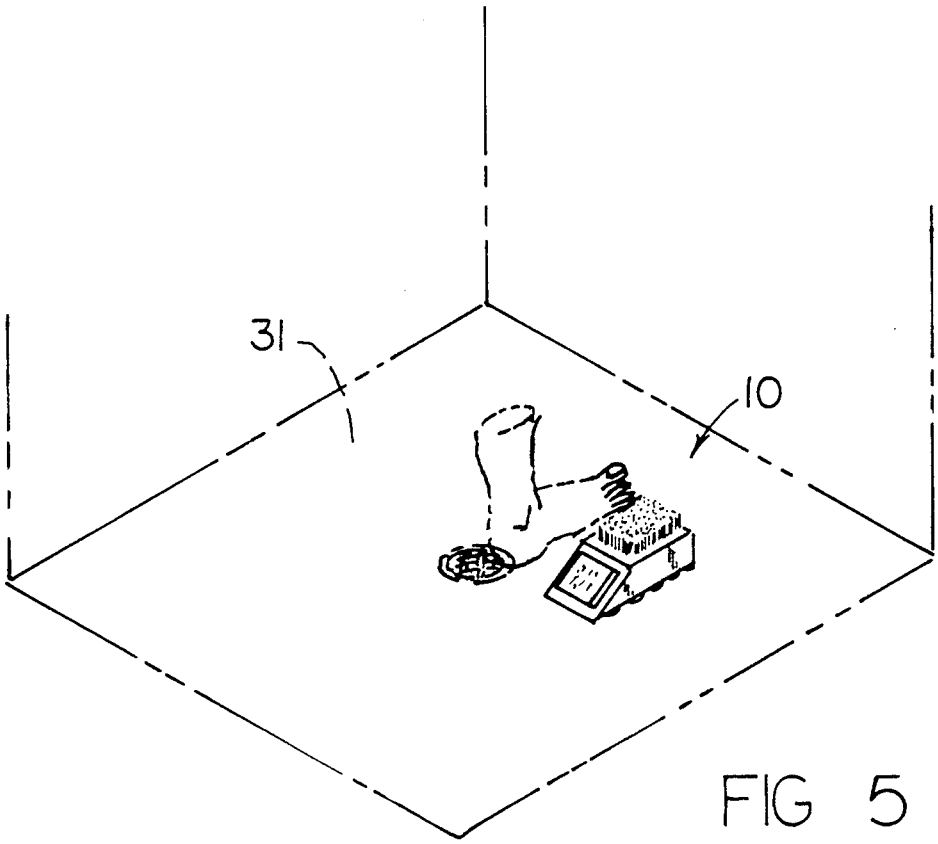
FIG. 5 is an isometric illustration of the instant invention in use within a shower stall.

With reference now to the drawings, and in particular to FIGS. 1 to 7 thereof, a new and improved foot scrubbing apparatus embodying the principles and concepts of the present invention and generally designated by the reference numeral 10 will be described.

More specifically, the foot scrubbing apparatus 10 of the instant invention essentially comprises a compressible housing 11 formed with accordion pleated side walls 12 and an accordion pleated rear wall 13. A housing top wall 14 extends orthogonally mounted relative to and joined to the housing side rear walls, while a housing second wall 15 joined to the housing top wall at an obtuse included angle 16 (see FIG. 3) is canted downwardly relative to the first top wall joined to the rigid housing floor plate 17. The housing floor plate 17 includes a matrix of suction cups 18 mounted thereto to permit selective securement of the housing relative to a shower stall floor 31 or a bathtub 30, as illustrated in the FIGS. 5 and 4 respectively. A first fill conduit 19 and a removable first fill conduit cap 19*a* are directed through the rear wall 13 to permit selective refilling of the rear wall of a cleaning solution fluid 32. The first top wall includes a matrix of first top wall fluid feed apertures 20 in communication with an interior cavity of the housing containing the cleaning fluid, wherein the second top wall 21 includes a matrix of top wall fluid feed apertures 21. A second top wall lid frame 22 is hingedly mounted to the second top wall at the intersection of the second top wall with the floor, and includes a central opening 23, with latch loops 24 mounted to opposing sides of the lid frame 22 for selective securement of the lid frame 22 to lugs 25 secured to the opposed side walls 12. A sponge head member is securable to the second top wall and includes a sponge head base 26 that is arranged coextensively with the second top wall 15, and having projecting head 27 complementarily received through the lid central opening 23. In this manner, a sponge flange 28 projects laterally about the projecting head 27 to be captured between the lid frame 22 and the second top wall 15.

In use, it may be appreciated that an individual by compression of the housing by the foot portion of that individual directs the cleaning fluid through the respective first and second top wall apertures 21 or 22 for use of the sponge projecting head 27 or the bristle matrix 29 in a cleaning procedure.

Figure 6:
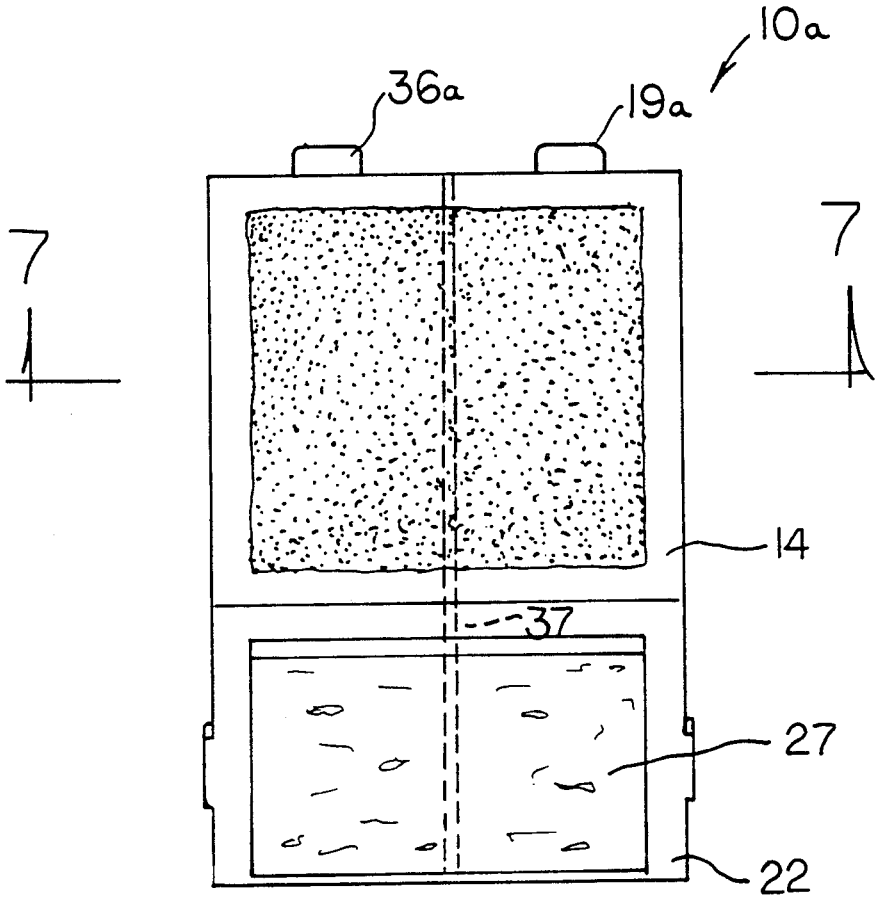
FIG. 6 is an orthographic top view of a modification of the invention.
Figure 7:
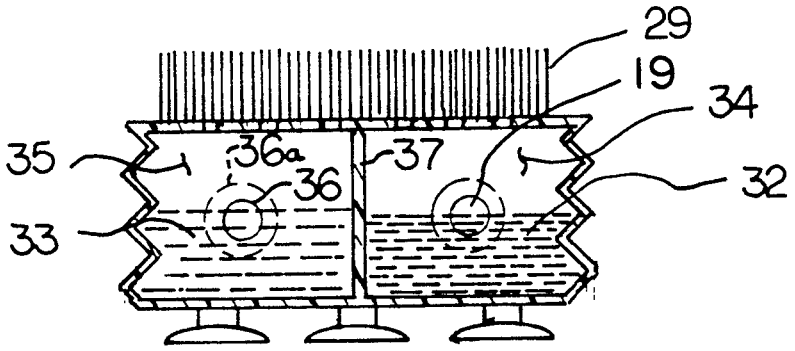
FIG. 7 is an orthographic view, taken along the lines 7—7 of FIG. 6 in the direction indicated by the arrows.

The FIGS. 6 and 7 illustrate a modified apparatus 10*a* that includes a flexible deformable partition wall 37 directed coextensively within the housing to define a housing first cavity 34 and a housing second cavity 35 to include a respective cleaning fluid 32 and a lotion therewithin. In this manner, the cleaning fluid 32 is refilled through the use of the first conduit 19 and as the lotion 33 is refilled through the second fill conduit 36 and the associated removable second fill conduit 36*a*. Use of the invention, as set forth in the FIGS. 6 and 7, permits the application of a plurality of fluids into the bristles 29 or the sponge head 27 for use by an individual in a cleaning procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A foot scrubbing apparatus, comprising, a compressible housing, the housing including a rigid floor plate, said rigid floor plate including an accordion pleated rear wall, and accordion pleated first and second side walls, and a housing first top wall orthogonally mounted to an upper terminal end of the first and second side walls and the housing rear wall, a second top wall mounted to the first top wall and being canted downwardly therefrom, said second top wall being oriented between the first and second side walls and joined to the floor plate, said floor plate spaced from the housing first top wall, and the first top wall including a matrix of first top wall apertures directed therethrough, and the second top wall including a matrix of second top wall apertures directed therethrough, and a matrix of bristles mounted to the first top wall, and a sponge member mounted to the second top wall, and the housing including at least one housing cavity, including a cleaning fluid contained therewithin, and said accordion pleated rear wall and said accordion pleated first and second side walls being compressible for directing the cleaning fluid through the first and second top wall apertures to the matrix of bristles and to the sponge member, and a first fluid conduit directed through the rear wall to effect selective filling of the at least one housing cavity.

2. An apparatus as set forth in claim 1 wherein the housing first top wall and the housing second top wall define an obtuse angle therebetween measured exteriorly of the housing.

3. An apparatus as set forth in claim 2, wherein the rigid floor plate includes a matrix of suction cup members mounted thereto extending downwardly relative to the floor plate.

* * * * *